US005327071A

United States Patent [19]

Frederick et al.

[11] Patent Number: 5,327,071

[45] Date of Patent: Jul. 5, 1994

[54] MICROPROCESSOR CONTROL OF MULTIPLE PEAK POWER TRACKING DC/DC CONVERTERS FOR USE WITH SOLAR CELL ARRAYS

[75] Inventors: Martin E. Frederick, Silver Spring; Joel B. Jermakian, Laurel, both of Md.

[73] Assignee: The United States of America as represented by the Administrator of the National Aeronautics & Space Administration, Washington, D.C.

[21] Appl. No.: 127,886

[22] Filed: Jul. 12, 1993

Related U.S. Application Data

[63] Continuation of Ser. No. 787,993, Nov. 5, 1991, abandoned.

[51] Int. Cl.[5] ..... G05F 5/00

[52] U.S. Cl. ..... 323/299; 323/906; 136/293

[58] Field of Search ..... 323/299, 303, 906; 136/293; 363/74, 78; 307/43; 320/32

[56] References Cited

U.S. PATENT DOCUMENTS

| | | | |
|---|---|---|---|
| 3,566,143 | 2/1971 | Paine et al. | 323/906 |
| 4,327,318 | 4/1982 | Kwon et al. | 320/39 |
| 4,375,662 | 3/1983 | Baker | 363/95 |
| 4,404,472 | 9/1983 | Steigerwald | 307/46 |
| 4,604,567 | 8/1986 | Chetty | 323/299 |
| 4,649,334 | 3/1987 | Nakajima | 323/299 |
| 4,873,480 | 10/1989 | Lafferty | 323/229 |

*Primary Examiner*—Steven L. Stephan
*Assistant Examiner*—Adolf D. Berhane
*Attorney, Agent, or Firm*—Paul S. Clohan, Jr.; R. Dennis Marchant; Guy M. Miller

[57] ABSTRACT

A method and an apparatus for efficiently controlling the power output of a solar cell array string or a plurality of solar cell array strings to achieve a maximum amount of output power from the strings under varying conditions of use. Maximum power output from a solar array string is achieved through control of a pulse width modulated DC/DC buck converter which transfers power from a solar array to a load or battery bus. The input voltage from the solar array to the converter is controlled by a pulse width modulation duty cycle, which in turn is controlled by a differential signal comparing the array voltage with a control voltage from a controller. By periodically adjusting the control voltage up or down by a small amount and comparing the power on the load or bus with that generated at different voltage values a maximum power output voltage may be obtained. The system is totally modular and additional solar array strings may be added to the system simply be adding converter boards to the system and changing some constants in the controller's control routines.

4 Claims, 5 Drawing Sheets

MICROPROCESSOR CONTROL OF MULTIPLE PEAK POWER TRACKING DC/DC CONVERTERS FOR USE WITH SOLAR CELL ARRAYS

ORIGIN OF THE INVENTION

The invention described herein was made by employees of the U.S. Government and may be manufactured and used by and for the U.S. Government for governmental purposes without the payment of any royalties thereon or therefore.

This application is a continuation of application Ser. No. 07/787,993, filed Nov. 5, 1991 now abandoned.

TECHNICAL FIELD

The present invention relates to a method of, and a system for maximizing the transfer of power from solar cells to a load or battery bus under varying conditions. More particularly, the present invention relates to a method of and an apparatus for controlling multiple peak power tracking DC/DC converters to maximize the power output of solar cell array strings.

BACKGROUND ART

Solar cells, whether singly or connected in an array, have been utilized to supply power in a wide variety of applications. Those applications for which solar power may be utilized encompass virtually any device or system which utilizes electric power, and range from terrestrial uses in solar powered vehicles and hot water heaters to extraterrestrial uses in spacecraft. Because of the increasing importance and employment of solar generated power, it is necessary to make the most cost effective and efficient utilization of the power generated by a solar array. This is particularly true in applications where size and weight are significant concerns, such as in terrestrial vehicles or spacecraft in which the size and weight of solar panels contributes significantly to the size and weight of the overall system.

Effective utilization of the power generated by a solar cell array requires that the solar array be controlled to operate at its most efficient point. The most efficient operating point of a solar cell or solar cell array may vary dependent upon a variety of factors including temperature, illumination level, the type of cell, radiation damage to the cell, the number of cells in series and other cell properties. In general, the solar cell array will operate at its most efficient point and output the greatest amount of power at a specific power maximizing voltage which is determined by the operating conditions.

One such system for determining the power maximizing voltage of a solar cell array string operates by sensing the power at the output of a solar cell array before a signal indicative of power has propagated through the power tracking circuitry of the system. Since there may be losses in the tracking circuitry which would move the peak power point for the whole system, these losses can not be taken into account by such a system.

Another known system controls a large number of solar array strings grouped together as one. Since each individual solar array string has its power output maximizing voltage determined by different factors, the best peak power point for the group of solar array strings is necessarily less than the peak power outputs of the individual strings when each string is operated at its own output maximizing voltage.

Another known category of peak power trackers utilizes various analog techniques to approximate the peak power point of each solar array string. However, according to this category of power maximizing system each peak power tracker is an independent unit having logic circuitry required to peak power track the individual string the unit is controlling.

DISCLOSURE OF THE INVENTION

Accordingly, one object of the invention is to provide a system which overcomes the disadvantages of the above-described systems.

A second object of the invention is to provide a control system for maximizing the transfer of power from solar cells to a load or battery bus in a simple and efficient manner.

Another object of the invention is to provide a control system for maximizing the transfer of power from solar cells to a load or bus which allows multiple solar cell array strings to be added to the system simply in a modular fashion.

A further object of the invention is to provide a method for controlling multiple solar cell array strings individually such that each string operates at its power maximizing voltage.

To achieve these and other objects, one embodiment of the present invention provides a system and method for controlling the power output of a solar array string which includes a peak power tracker unit coupled between a solar array string and a load or battery bus. The peak power tracker unit may comprise a pulse width modulated DC/DC converter to transfer power from the solar cell string to the battery or load. The input voltage to the tracker unit is controlled by the pulse width modulation duty cycle which is in turn controlled by a differential signal which compares the solar array string voltage with a control voltage provided by a controller. The controller periodically adjusts the control voltage upwards and downwards by a small amount and compares the power out of the solar array string at each of the control voltages. Whichever control voltage produces a greater power output becomes the point at which the string is set to operate. The process of adjusting the control voltage is iteratively repeated until the maximum power output point for a solar array string is achieved.

A preferred embodiment of the invention includes multiple solar cell array strings connected to individual peak power tracker units. Each of the solar cell array strings are individually peak power tracked in a manner similar to that described above. The outputs of each of the individual tracker units are connected in parallel. According to this embodiment, new solar cell array strings may be added to the system in a modular fashion simply by adding additional tracker units and adjusting a control routine to account for the additional units. According to the preferred embodiment, an analog demultiplexer interfaces the controller to each of N, power tracker units, thus allowing each of N solar array strings to be controlled individually.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

BEST MODE FOR CARRYING OUT THE INVENTION

Figure 1:
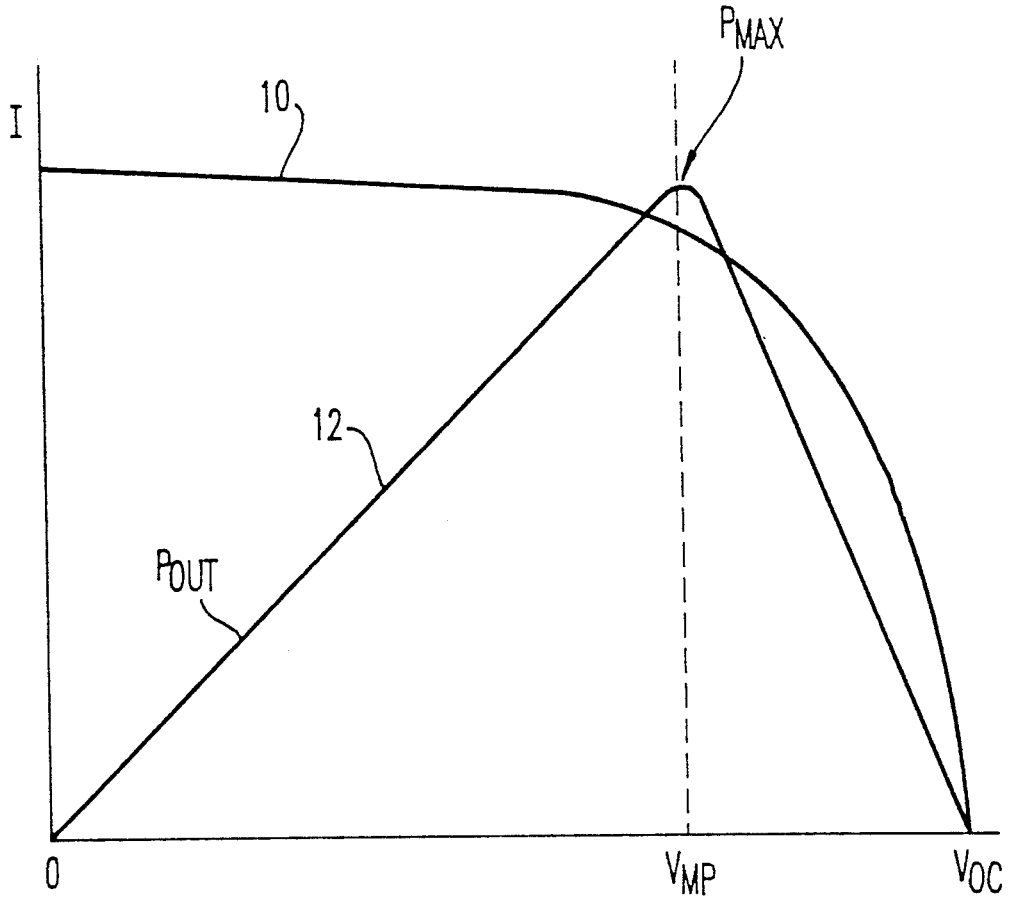
FIG. 1 is a graph illustrating a typical I/V characteristic and a curve illustrating power output and the peak power point for a solar cell array.

Referring now to the drawings, wherein like reference numerals designate identical or corresponding parts throughout the several views, and more particularly to FIG. 1 thereof, a current/voltage characteristic 10 of a typical solar cell or array in sunlight is illustrated, along with a curve 12 which plots power output $P_{OUT}$ of the cell or array. The power generated by a cell or array for any operating point along the characteristic curve 10 may be found by multiplying the values for the voltage and current at that point. As can be seen in FIG. 1, the power output $P_{OUT}$ ramps upward as voltage increases and current remains relatively constant until reaching a point $P_{MAX}$ corresponding to a voltage $V_{MP}$ where power output is maximized. Moving further along the $P_{OUT}$ curve, as voltage increases to a voltage $V_{OC}$ corresponding to an open circuit array voltage, power out drops to zero. By adjusting the operating point of the cell or array to the point $V_{MP}$, power output of the array is maximized and the most efficient use of the solar cell or array may be realized.

Figure 2:
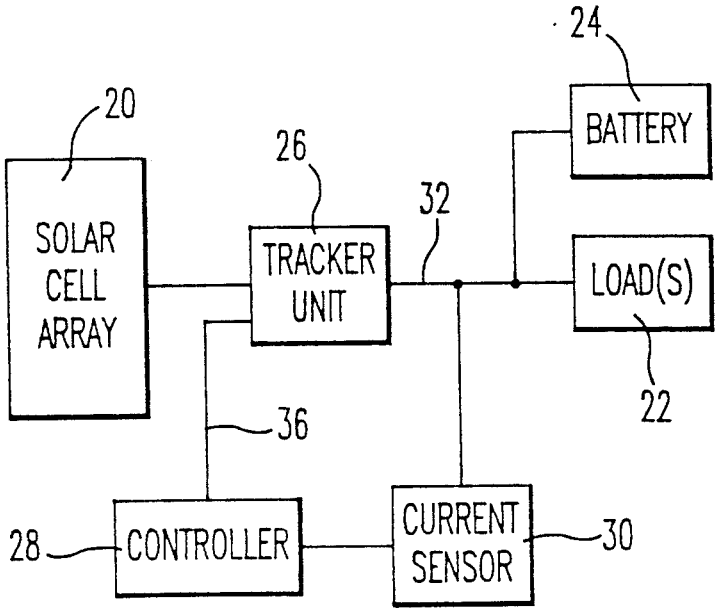
FIG. 2 is a block diagram of a system for maximizing the power transfer between a solar cell array and a load or battery according to the present invention.

FIG. 2 illustrates a block diagram of a system according to the present invention for controlling the operating point of a solar cell or array such that it operates at its power maximizing voltage $V_{MP}$, thereby maximizing the transfer of power between the cell or array and a battery or load(s). The system includes a tracker unit 26 arranged to receive electrical power generated by solar cell array 20 and to provide the load(s) 22 and battery 24 with direct current power such that the output power of the solar cell array 20 is maximized. The tracker unit 26, which will be described in more detail hereinafter, serves to decouple the solar cell array 20 from the load(s) 22 and battery 24 in order that the load(s) and battery may operate at a voltage independent of the solar cell array, and the solar cell array may operate at its most efficient point. This most efficient operating point for the array 20 may be located by controller 28 according to a method, described in detail hereinafter, wherein a value of power output by the array to a load or battery bus is measured at different operating points of the array, and the measured power values are compared until the peak power point for an array string is located.

The power output to the battery or load may be measured by a conventional type of current sensor 30 on bus 32. The current output on bus 32 represents the power output by the array 20 because the voltage output is essentially predetermined based upon the voltage at which the battery 24 or loads 22 operate. Therefore, since power = voltage × current, and the voltage at the battery 24 or loads 22 is relatively constant, current serves as an indication of the power output. Additionally, it should be noted that by sensing the power at the output of the tracker unit 26, losses which would move the peak power point for the whole system and which are caused by the propagation of the solar cell array output through the tracker unit are automatically taken into account. Controller 28, which may comprise any type of programmable computing device capable of receiving input signals and outputting a control signal, receives a signal indicating the power on the bus 32 from current sensor 30 and outputs a control signal, determined as hereinafter described, on line 36 to tracker unit 26. The control signal 36 serves to adjust a tracker unit 26 setpoint voltage which will cause the array 20 voltage to change as well. This in turn will cause the power output from the tracker unit 26 to vary. Thus, the current sensor 30, controller 28 and tracker unit 26 form a closed loop system whereby the current output by tracker unit 26 may be iteratively adjusted until the maximum power output of solar cell array 20 is obtained.

Although the embodiment described above and illustrated in FIG. 2 includes only a single solar cell array 20 coupled by a tracker unit 26 to a battery 24 or loads 22, the peak power tracking system according to the invention is particularly suited to modularity wherein additional solar cell array sections may be added and each array may be individually controlled to operate at its most efficient point.

Figure 3:
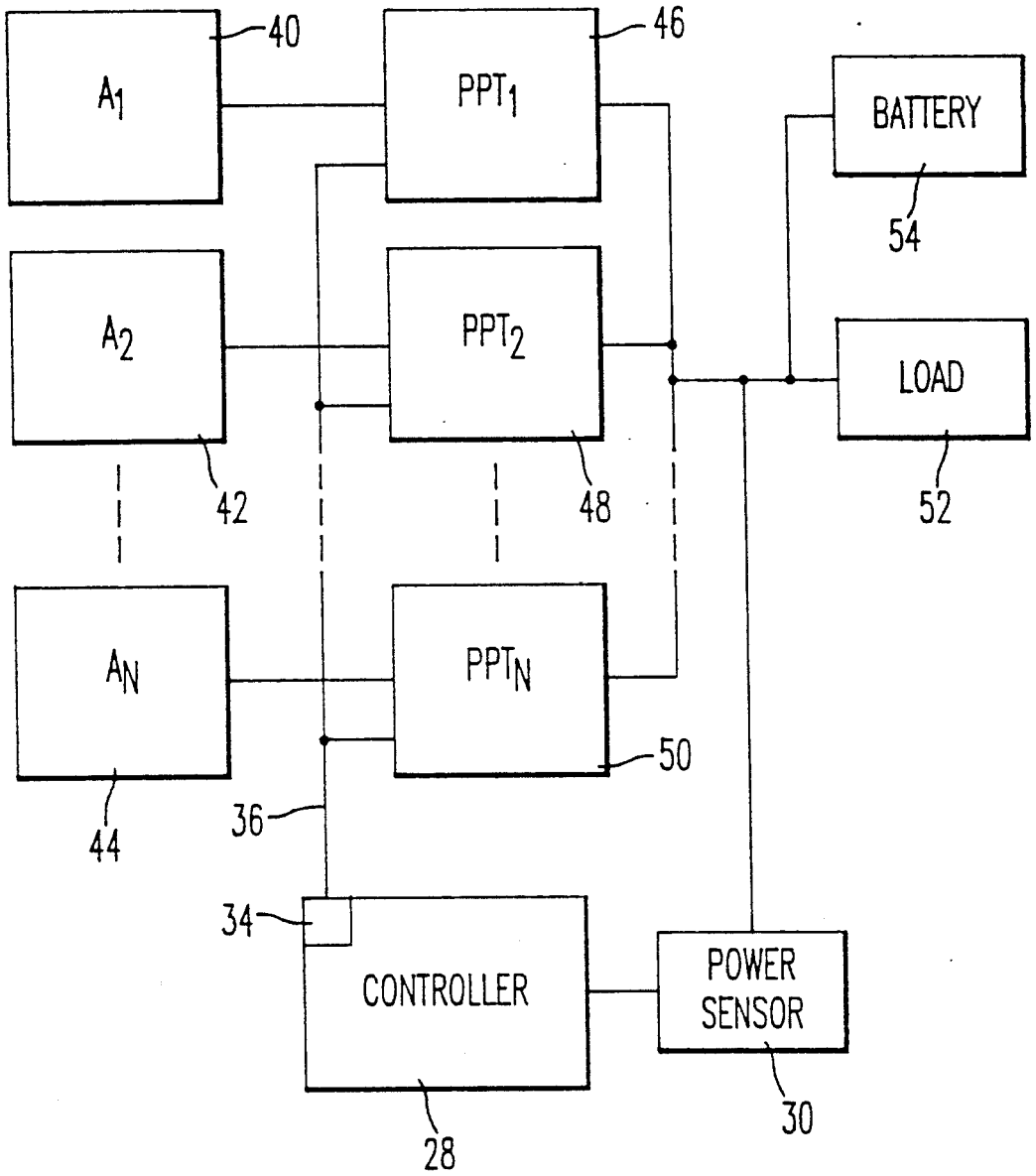
FIG. 3 is a block diagram of a preferred embodiment of a system of the present invention for maximizing power transfer in a multiple solar cell array system using multiple power trackers.

FIG. 3 illustrates a preferred embodiment of the present invention wherein multiple solar cell arrays 40, 42, 44 are each coupled to a power tracker unit 46, 48, 50, respectively, and the combination of arrays and power trackers are connected in parallel to power a load 52 or battery 54. The modularity of the system is provided via tracker units 46, 48, 50 and interface 34 which is preferably an analog demultiplexer with sample and hold circuitry. Additional solar array strings may be added to the system and peak power tracked simply by adding another tracking unit. Interface 34 connects the controller 28 to the tracker units, and allows the controller 28 to output control signals to N different tracker units such that each solar cell array string 40, 42, 44 may be controlled individually to determine its peak power point. Thus, in order to add an additional array to the system an additional tracker unit is added and minor changes are made in the control routine executed by controller 28 to account for the additional units.

In the embodiment illustrated in FIG. 3, each of the output currents from the multiple arrays are connected together and the total output of the solar array strings 40, 42, 44 are measured by power sensor 30 in order to provide a signal to controller 28 indicative of the power output to the load or battery. However, since the output of one solar array string at a time is being adjusted, the only change in output power is due to the change in the power output on one solar array string. If, for example, ten strings are being monitored and each string is putting out 1 amp of current, the total output will be 10 amps. Any change in output current due to an individual solar array string out of the ten will be a small fraction of the total output current. Therefore, in order to provide better resolution in detecting power output changes, individual current sensors may be provided to detect the current output due to each string individually rather than the total current output of all strings. In terrestrial applications where there are no space constraints, it would be expedient to use individual current sensors. However, in extraterrestrial applications and other applications where space and weight concerns are a factor, it is preferable to utilize one current sensor for sensing the total output current.

Figure 4:
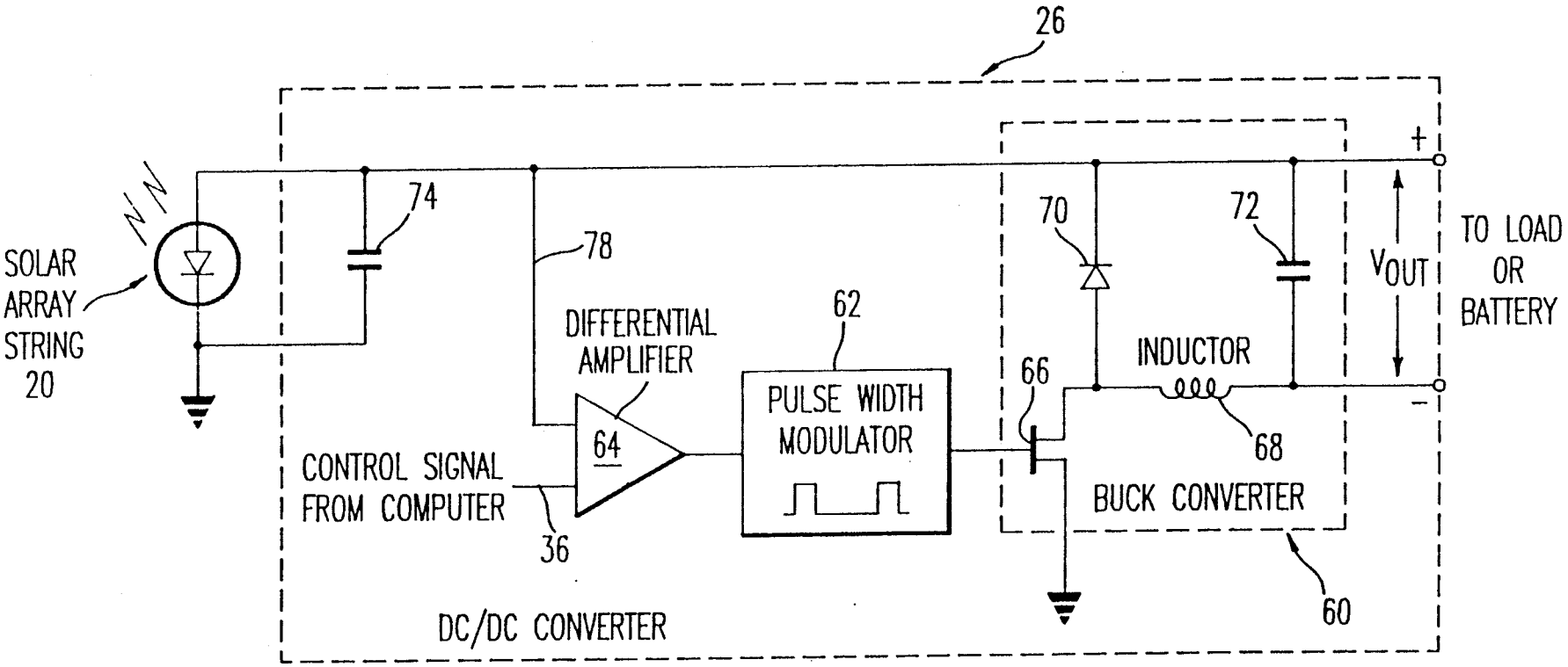
FIG. 4 is a schematic circuit diagram of a tracker unit which may be utilized in the present invention.

With reference to FIG. 4, the operation of the power tracker unit 26 according to the present invention will be described. The tracker unit 26 includes a DC-DC buck converter 60, a pulse width modulator 62, a differential amplifier 64, a capacitor 72 and a capacitor 74. The positive side output from the buck converter 60 is connected to the positive side terminal of solar array string 26. The negative terminal of the solar array string 20 is connected to the negative side of transistor 66 which acts as an electrical switch. When switch 66 is ON, current flows from the solar array out to a load or battery bus. When switch 66 is turned OFF, inductor 68 will keep current flowing, forcing current through diode 70, and the solar array string 20 stores its current in capacitor 74. Capacitor 72 acts as a smoothing capacitor to eliminate instantaneous changes in voltage by changing the time constant on the output in order to smooth the output. Thus, the voltage of the solar array 20 can be made to vary dependent on the duty cycle of switch 66. An increase in the duty cycle causes the solar array voltage to decrease. A decrease in the duty cycle of switch 66 causes the solar array voltage to increase. Accordingly, the duty cycle of switch 66 is controlled via a pulse width modulated signal supplied from pulse width modulating circuitry 62. The signal fed to the pulse width modulating circuitry 62 is determined by the output of a differential amplifier 64 whose inputs are a signal 78 indicating solar array voltage and a signal 36 from the controller 28.

As described previously, the controller 28 outputs a control signal 36 to the tracker unit 26 in order to adjust the power output of the solar array string 26. The control signal 36 is a voltage signal which the controller outputs to search for the power maximizing voltage Vmp. Thus, if the control signal 36 supplies a voltage which is lower than the solar array voltage signal 78, the duty cycle of the pulse width modulator is increased in accordance with the output from the differential amplifier, thereby decreasing the solar array 20 voltage output. If the signal 36 supplied to the differential amplifier 64 is greater than the array voltage signal 78 the differential amplifier 64 output will cause the duty cycle of the pulse width modulator 62 to decrease, thereby increasing the solar array 20 voltage output.

Figure 5:
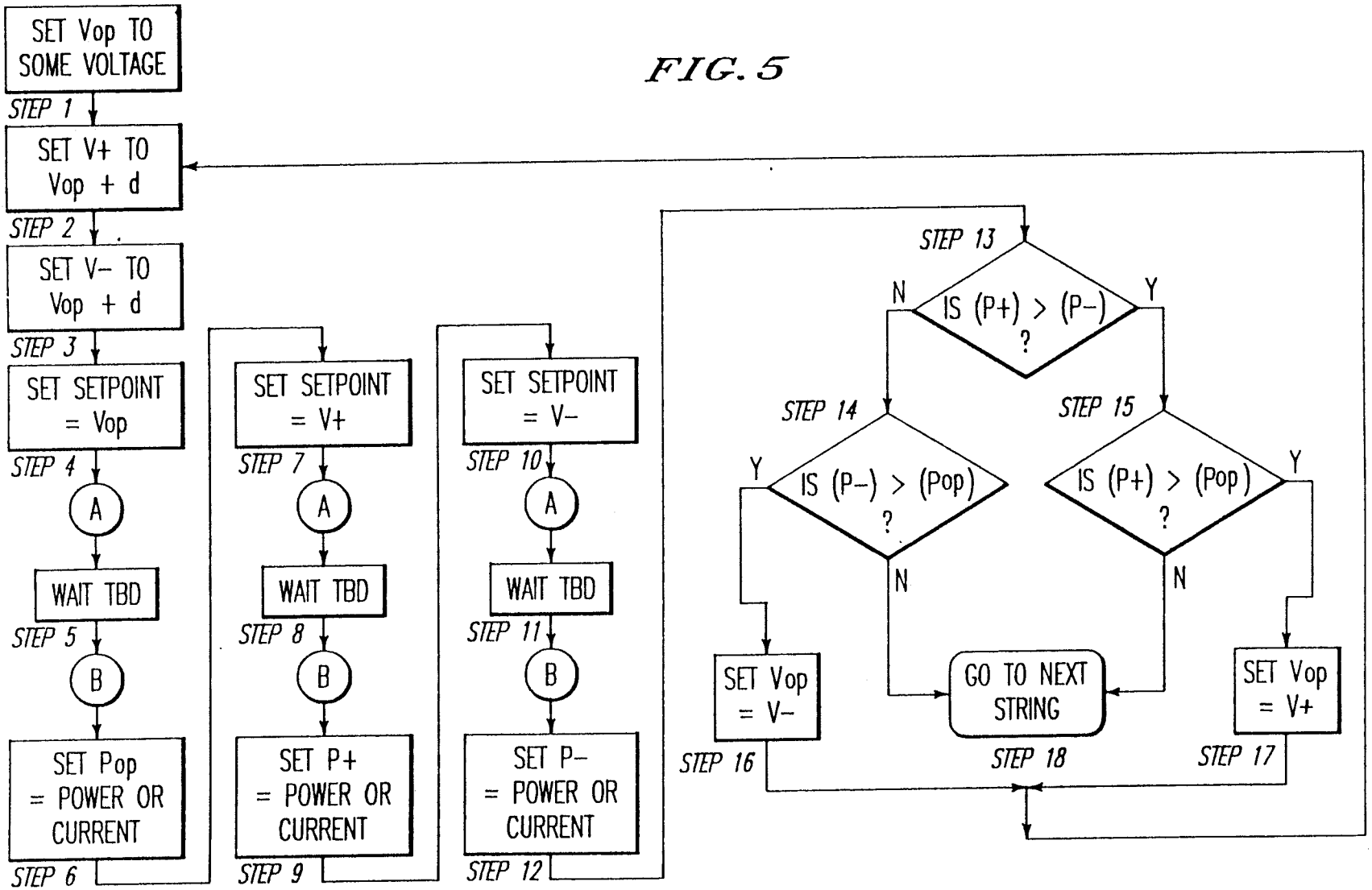
FIGS. 5, 6A and 6B are flow diagrams illustrating a general method for controlling a tracker unit such that a solar array being controlled in accordance with the present invention operates at a maximum power point.
Figure 6B:
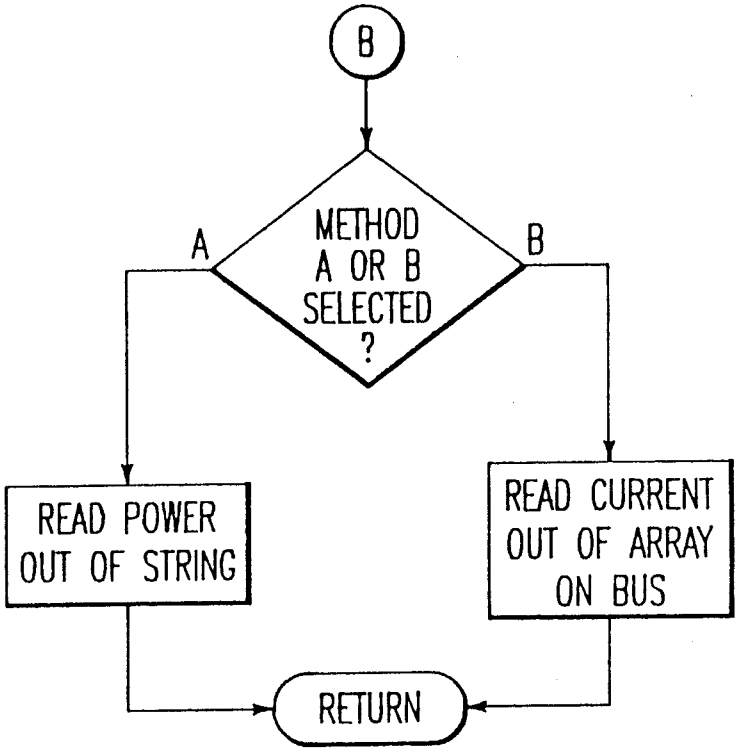
Figure 6A:
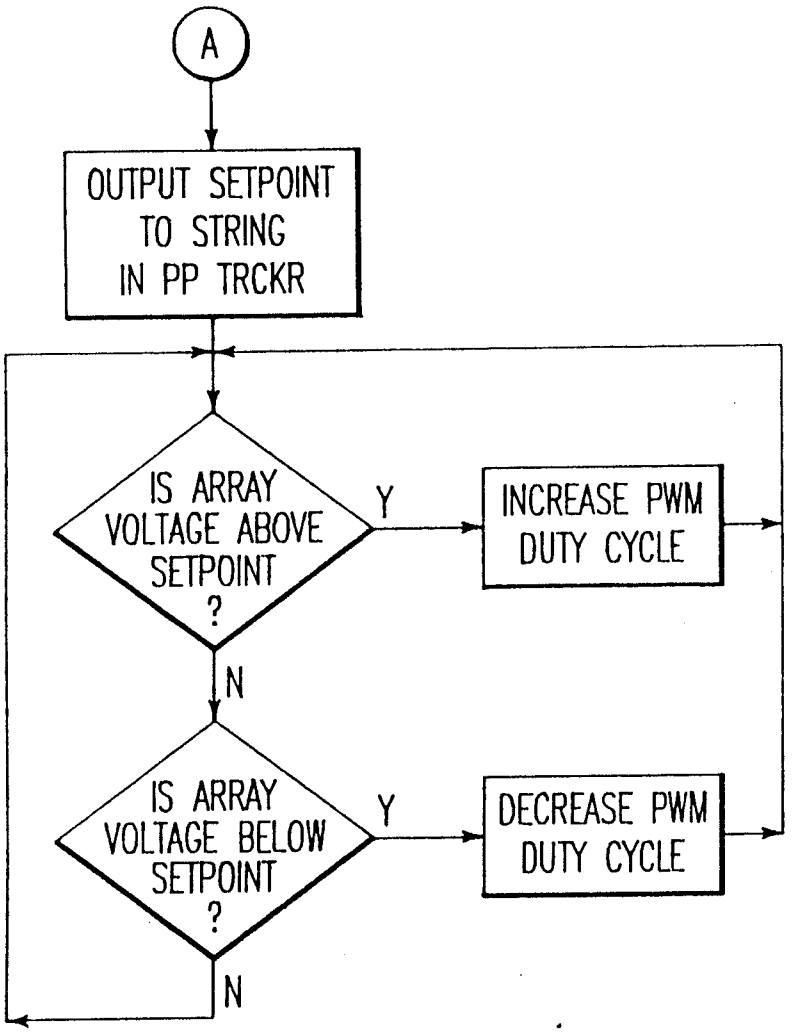

Referring now to FIGS. 5, 6A and 6B, a control routine which is executed by controller 28 in order to generate control signal 36 is illustrated. The control signal 36 is adjusted iteratively according to the control routine and is supplied to tracker unit 26 to produce the maximum power output for a solar array string. In STEP 1, the controller is intiallized to a voltage value $V_{OP}$ representing the operating voltage of a solar array string. This initial voltage can be chosen randomly in order to begin the process of determining the power maximizing voltage $V_{MP}$. Next, two other values of voltage are set in STEP 2 and STEP 3, which values are incrementally larger than $V_{OP}$ and incrementally smaller than $V_{OP}$, respectively. Specifically, STEP 2 sets a voltage V+ which equals $V_{OP}$+d, where d is a small value of voltage. Similarly STEP 3 sets a voltage V− which equals $V_{OP}$−d. Thus, STEPS 1-3 establish a range of three voltages from which a power maximizing voltage will be selected. In STEP 4, a SETPOINT voltage which corresponds to the signal 36 output from controller 28 to tracker unit 26 is set equal to the middle voltage $V_{OP}$. Next, in Subroutine A which corresponds to the operations performed by the differential amplifier logic 64 shown in FIG. 4, the SETPOINT is output to the differential amplifier 64 as control signal 36.

As described above, the differential amplifier compares the array voltage with the SETPOINT voltage and outputs a differential signal. If the array voltage is greater than the SETPOINT, the pulse width modulator 62 duty cycle is increased in order to increase the output power of the array. If the array voltage is below the SETPOINT, the pulse width modulator 62 duty cycle is decreased according to the signal from differential amplifier 64 and the output power of the array is decreased. After outputting the SETPOINT voltage to the tracker unit 26 a WAIT period occurs in STEP 5 in order to let the electronic components of the system settle down. The WAIT occurring in STEP 5 is on the order of milliseconds and may be, for example, 5-10 milliseconds. After having output SETPOINT voltage $V_{OP}$ to the tracker unit in subroutine A and waited for the electronic components to settle, subroutine B is executed in which either the power output of a string or the current output of the array bus 32 is read by current sensing circuitry 30. Whichever value is sensed depends upon whether the current sensing circuitry senses individual strings or the entire current on the bus. In other words, either the sum of all the currents of the string taken together is read or just one string by itself is read to determine the power output at voltage $V_{OP}$. Thus, a first power reading is obtained and that reading is set equal to a variable $P_{OP}$ in STEP 6. Next, in STEP 7-STEP 10 the value V+ set in STEP 2 is sent to the tracker unit 26 in the same manner described with respect to $V_{OP}$ in STEP 4-STEP 7, and the power output measured in subroutine B is set to a value P+ in STEP 9. Similarly, in STEP 10-STEP 12 the value V− set in STEP 3 is sent to the tracker unit and the power output measured is set to a variable P− in STEP 12. After having set three values P+, $P_{OP}$ and P− in STEPs 6, 9 and 12, respectively, corresponding to power output from tracker unit 26 when the array voltage is set by V+, $V_{OP}$ and V−, respectively, STEP 13-STEP 17 are executed to determine which of the three voltage values V+, $V_{OP}$, V− results in greater power output to the load or battery. In STEP 13 the power value P+ is compared with the power value P− to determine which power value is greater, and correspondingly, to determine which value of voltage V+ or V− resulted in greater power output. If P+ is not greater than P−, it is then determined whether P− is greater than $P_{OP}$ in STEP 14. If P+ is greater than P− then it is determined whether P+ is greater than $P_{OP}$ in STEP 15. Essentially, STEP 13-STEP 15 perform a sorting of the values P+, $P_{OP}$ and P− to determine which is the greatest power value of the three. Thus, in STEP 14 if P− is not greater than $P_{OP}$ this means that the value of $P_{OP}$ is greater than both P− and P+ and, therefore, corresponds to the peak power point for the string. Thus, the voltage corresponding to the peak power point is set, and the peak power point for a new string can then be determined in STEP 18. However, if P− is found greater than $P_{OP}$ in STEP 14, $V_{OP}$ is set to V− and the procedure set forth in STEP 2-STEP 12 is repeated using V− as $V_{OP}$. Likewise, if P+ is not found to be greater than $P_{OP}$ in STEP 15 then $P_{OP}$ corresponds to the peak power point and the peak power point for another string may then be determined in STEP 18. If P+ is greater than $P_{OP}$ in STEP 16, then the peak power point has not been reached and $V_{OP}$ is set to V+ in STEP 17 and STEP 2–STEP 12 are repeated using V+ as the new $V_{OP}$. STEP 2–STEP 12 may be repeated until a peak power point is reached for the particular string being tracked.

The above-described method for setting the peak power point of a solar array string represents a general method which is executed by controller 28 to produce a signal output to the tracker unit 26. However, the control routine may be easily modified. For example, in order to prevent the control routine from getting stuck in determining the peak power point for a particular solar array string, which may be defective or malfunctioning, the control routine can be modified such that the SETPOINT is only moved a predetermined number of times before going on to determine the peak power point for the next solar array string. Further, for greater noise protection, the routine may be repeated a set number of times and the peak power values averaged to determine a peak power point. Additionally, a routine for estimating $V_{OP}$ such that $V_{OP}$ is initially set near the peak power point may be performed prior to the peak power determination.

Obviously, numerous modifications and variations of the present invention are possible in light of the above teachings. It is therefore to be understood that within the scope of the appended claims, the invention may be practiced otherwise than as specifically described herein.

We claim:

1. A solar powered system, comprising:

a plurality of solar cell array strings;

means for receiving power generated by the plurality of solar cell array strings;

a plurality of power tracking means coupled to respective solar cell array strings and to said means for receiving power generated by the plurality of solar cell array strings for regulating the voltage of the respective solar cell array strings;

means for sensing the power output of the solar powered system connected to the output of the plurality of power tracking means and producing at least one sensed power output signal; and a singular control circuit which receives at least one signal indicating power output from the means for sensing, and which supplies a separate control signal to each of the plurality of power tracking means thereby to individually regulate a voltage of each of the plurality of solar array strings such that a maximum power is output to the means for receiving.

2. The system according to claim 1, wherein the means for sensing power output comprises:

a plurality of sensors for sensing the power output of respective solar array strings and producing respective sensed power output signals; and wherein the singular control circuit receives the sensed power output signals from each of the plurality of sensors.

3. The system according to claim 1, wherein the means for sensing power comprises:

a sensor for sensing a total power generated by the plurality of solar array strings; and wherein the singular control circuit receives the sensed power signal from the sensor.

4. The system according to claim 1, wherein the singular control circuit comprises:

means for iteratively outputting a series of control signals to respective power tracking means, and means for determining which control signal output to the respective power tracking means produces a maximum power output for each respective array string.

* * * * *